US007673039B2

(12) United States Patent
Sakamoto et al.

(10) Patent No.: US 7,673,039 B2
(45) Date of Patent: Mar. 2, 2010

(54) SERVER APPARATUS AND INFORMATION PROVIDING METHOD

(75) Inventors: Kenji Sakamoto, Tokyo (JP); Goro Kunito, Tokyo (JP); Kenichi Yamazaki, Tokyo (JP)

(73) Assignee: NTT DoCoMo, Inc., Tokyo (JP)

( * ) Notice: Subject to any disclaimer, the term of this patent is extended or adjusted under 35 U.S.C. 154(b) by 1001 days.

(21) Appl. No.: 10/930,777

(22) Filed: Sep. 1, 2004

(65) Prior Publication Data

US 2005/0099295 A1 May 12, 2005

(30) Foreign Application Priority Data

Sep. 5, 2003 (JP) ..... P2003-314469

(51) Int. Cl.
*G06F 15/173* (2006.01)

(52) U.S. Cl. ..... 709/224; 340/10.42; 340/540

(58) Field of Classification Search ..... 709/224, 709/223; 340/10.42, 540, 541, 10.2
See application file for complete search history.

(56) References Cited

U.S. PATENT DOCUMENTS 6,489,921 B1 * 12/2002 Wilkinson ..... 342/357.08
6,965,298 B2 * 11/2005 Feinberg ..... 340/10.41
6,987,451 B2 * 1/2006 McKeown et al. ..... 340/541
6,995,655 B2 * 2/2006 Ertin et al. ..... 340/10.2
7,009,495 B2 * 3/2006 Hughes et al. ..... 340/10.2
7,112,132 B2 * 9/2006 Yamagishi ..... 463/1
7,135,974 B2 * 11/2006 Hernandez et al. ..... 340/572.1
2002/0178224 A1 * 11/2002 Kasajima ..... 709/206
2003/0020634 A1 1/2003 Banerjee et al.
2003/0144926 A1 * 7/2003 Bodin et al. ..... 705/28

(Continued)

FOREIGN PATENT DOCUMENTS

GB 2 377 342 A 1/2003

(Continued)

OTHER PUBLICATIONS

"RFID for Traffic Control", International Business Machines Corporation, vol. 421, No. 140, XP-007124399, May 1999, 2 pages.

*Primary Examiner*—Oanh Duong
(74) *Attorney, Agent, or Firm*—Oblon, Spivak, McClelland, Maier & Neustadt, L.L.P.

(57) ABSTRACT

To overcome problems there is to be provided useful information to a user, by counting the number of detected RF tags. As a means for solving the problems an information-providing server 20 according to the present invention acquires IDs of RF tag readers disposed near by the Ferris wheel, when there has been presented to the information providing server 20, as a notifying condition, the condition that a user desires to receive an e-mail on the occasion of the number of persons waiting in line for a Ferris wheel having become seven or less. Then after having acquired the number of plural IDs of the RF tags detected by the RF tag readers having the acquired IDs, the information-providing server 20 acquires attribute information of the RF tags. The information providing server 20 counts the number of IDs of RF tags whose attribute is a person, referring to the attribute information. When the counted result has become seven or less, the information providing server 20 transmits an e-mail notifying to the effect that the congestion has been relieved to the mobile terminal 10.

8 Claims, 11 Drawing Sheets

U.S. PATENT DOCUMENTS

2003/0154017 A1 8/2003 Ellis

FOREIGN PATENT DOCUMENTS

| | | | |
|---|---|---|---|
| JP | 2001-307287 | | 11/2001 |
| JP | 2001-325300 | | 11/2001 |
| JP | 2002-230685 | | 8/2002 |
| JP | 2003085395 | A * | 3/2003 |
| JP | 2003-94858 | | 4/2003 |
| JP | 2003-097884 | | 4/2003 |
| JP | 2003-186983 | | 7/2003 |
| WO | WO 97/18534 | | 5/1997 |
| WO | WO 02/071338 | A1 | 9/2002 |
| WO | WO 03/007247 | A1 | 1/2003 |

* cited by examiner

Fig.2

22

| 22a SPECIFIED READER ID | 22b ATTRIBUTE OF OBJECT | 22c THRESHOLD VALUE | 22d NOTIFYING CONTENTS | 22e DESTINATION |
|---|---|---|---|---|
| 41<br>42<br>43 | (a)<br>PERSON | (b)<br>7 OR LESS | (c)<br>CONGESTION RELIEF | aaa@bbb |
| 81<br>82<br>83 | (d)<br>CAR | (e)<br>5 OR MORE | (f)<br>SHOW DETOUR | 192.168.0.2 |
| 41<br>42<br>43 | (g)<br>PERSON | (h)<br>DIFFERENCE FROM PREVIOUS TIME IS NEGATIVE | (i)<br>HAS BEGUN TO DECREASE | aaa@bbb |

A

*Fig.3*

| 31 LOCATION OF PLACE | 32 READER ID |
|---|---|
| IN FRONT OF FERRIS WHEEL | 41<br>42<br>43 |
| THIS SIDE OF TRAFFIC SIGNAL POSITIONED AHEAD OF RF TAG READER 71 | 81<br>82<br>83 |

Fig.4

50

51 52

| ID | ATTRIBUTE INFORMATION |
|---|---|
| 600 | PERSON, HARUKO YAMADA, FEMALE, STUDENT |
| 601 | BAG,MADEINTAIWAN,MANUFACTUREDIN2002,BROWN,XXX(BRAND NAME) |
| 610 | PERSON, TAKAKO KIMURA, FEMALE, OFFICE WORKER, LIKING FOR FRENCH CUISINE |
| 611 | BAG, MADE IN JAPAN, MANUFACTURED IN 2001, BROWN, NO BRAND NAME |
| 620 | PERSON,TAROSATO,MALE,IN HIS THIRTIES, COMPANY EMPLOYEE,LIVING IN SETAGAYA |
| 621 | BAG, MADE IN CHINA, MANUFACTURED IN 2003, BROWN,GRIP:70kg |
| 630 | PERSON,MASAO YAMADA, MALE, CHARACTER:GENTLE, EXECUTIVE |
| 631 | HAT, MADE IN CHINA, MANUFACTURED IN 2002, MATERIAL:SILK |
| 640 | PERSON, HARUO KIMURA, MALE, IN HIS THIRTIES, COMPANY EMPLOYEE, U.S. NATIONALITY |
| 641 | BAG, MADE IN TAIWAN, MANUFACTURED IN 2001, BROWN, WITH POCKET FOR MOBILE PHONE |
| 650 | PERSON,ISAO NAKAMURA, MALE, HEIGHT:180cm, CHARACTER:HIS OWN WAY |
| 651 | BAG, MADE IN JAPAN, MANUFACTURED IN 2003, MATERIAL:IVORY |
| 652 | MOBILE PHONE, P505i, E-MAIL ADDRESS:hoge@hoge |
| 660 | PERSON, HIROKO YAMAMOTO, FEMALE, IN HER TWENTIES, LIVING IN YOKOSUKA |

Fig.7

50

51 52

| ID | ATTRIBUTE INFORMATION |
|---|---|
| 90 | CAR,SEDAN,MANUFACTURED IN 1998,4DOORS,GREEN,WITHCAR NAVIGATION APPARATUS |
| 91 | CAR,4WD,MANUFACTURED IN 1993,2DOORS,CAMOUFLAGED COLOR,3000cc |
| 92 | CAR, TRUCK, MANUFACTURED IN 1990, FOR 1 PERSON, FOR RICE-PLANTING |
| 93 | CAR,SEDAN,MANUFACTURED IN 1998,MADE IN JAPAN,4DOORS,ORANGE |
| 94 | CAR, TANK TRUCK, MANUFACTURED IN 1989, 2 DOORS, ONLY FOR GASOLINE |
| 95 | CAR, BUS, MANUFACTURED IN 1994, MADE IN CHINA, FOR 50 PERSONS |
| 96 | CAR, BUS, MANUFACTURED IN 1989, TWO-STORIED, RED, FOR 70 PERSONS |
| 97 | CAR, SEDAN, MANUFACTURED IN 1998, WITH CAR NAVIGATION APPARATUS (IP ADDRESS:192.168.0.2) |
| 98 | PERSON, HARUO SATO, MALE, IN HIS TWENTIES, LIVING IN YOKOSUKA |

*Fig.10*

100

101 102

| TIME | NUMBER OF RF TAGS HAVING THE SAME ATTRIBUTE |
|---|---|
| 13:00 | PERSON:4, BAG:2, MOBILE PHONE:1 |
| 13:05 | PERSON:5, BAG:2, HAT:1, MOBILE PHONE:1 |
| 13:10 | PERSON:8, BAG:5, HAT:2, MOBILE PHONE:1 |
| 13:15 | PERSON:7, BAG:5, HAT:1, MOBILE PHONE:1 |

SERVER APPARATUS AND INFORMATION PROVIDING METHOD

BACKGROUND OF THE INVENTION

1. Field of the Invention

The present invention relates to a server apparatus and an information providing method.

2. Related Background Art

Conventionally, a commodity management system utilizing RF tag has been proposed. For example, in the patent literature 1, there is disclosed a book distribution system, in which the genuine/false decision of a point coupon of a book is carried out by comparing the information of RF tag built-in the point coupon in the book jacket with the information of issued RF tag registered in the server of the publisher. In this book distribution system, only in the case where the point coupon is determined to be genuine, the point coupon is made to be available as a note being equivalent to cash. Thereby, a convenience is provided to a normal purchaser, while sold books are prevented from being returned illegally.

[Patent Literature 1] Japanese Unexamined Patent Publication No. 2003-94858

SUMMARY OF THE INVENTION

However, at the above-mentioned conventional technology, the information regarding individual commodity can be acquired by utilizing the RF tag, but out of consideration is the acquisition of the information about the number of the commodities. Consequently, for example, there has been no acquiring any information regarding the number of times of the illegal return of books or the information regarding the ratio of the normally purchased books to the totally purchased books. Providing this kind of useful information is the prerequisite to the count of the detected RF tags, and there has been made no proposal to count the number of RF tags in the book distribution system as well as the other systems.

It is therefore an object of the present invention to be able to provide useful information to users by counting the number of detected RF tags.

For achieving the above-mentioned object, according to the present invention, there is provided a server apparatus comprising an identification information acquisition unit for acquiring identification information of RF tags detected by RF tag readers, an attribute information acquisition unit for acquiring attribute information of the RF tags having the identification information acquired by the identification information acquisition unit, a counting unit for counting the number of RF tags corresponded to predetermined attribute information from among the detected RF tags, and a transmitting unit for transmitting information corresponding to a predetermined condition, in the case where the number of the RF tags counted by the counting unit satisfies the predetermined condition.

According to the present invention, there is provided an information providing method comprising the steps as follows: an identification information acquisition step for acquiring identification information of RF tags detected by RF tag readers, an attribute information acquisition step for acquiring attribute information of the RF tags having the identification information acquired by the identification information acquisition step, a counting step for counting the number of RF tags corresponded to predetermined attribute information from among the detected RF tags, and a transmitting step for transmitting information corresponding to a predetermined condition, in the case where the number of the RF tags counted by the counting step satisfies the predetermined condition.

According to the present invention, on occasion of reception of identification information of the RF tags detected by the RF tag readers, attribute information of the RF tags having the identification information is acquired. Thereafter, by referring to the acquired attribute information, the number of RF tags associated with predetermined attribute information is counted. In the case where the counted result satisfies a predetermined condition such as being above a threshold value or below a threshold value, information corresponding to the predetermined condition is transmitted. One RF tag is attached to a person or an article individually, therefore, the server apparatus can detect the number of persons or articles by counting the number of detected RF tags. Thereby, the server apparatus can provide not only the information based on the existence or not of articles or the presence or not of persons, but also the information based on quantity such as a congestion situation or state involved in excess or in shortage to users.

According to the present invention, the server apparatus further comprises a receiving unit for receiving information regarding a location of place. And the identification information acquisition unit acquires identification information of RF tags detected by RF tag readers disposed near by the location of place.

In view of the case where a user desires to know the congestion state at a location of site X or the stock shortage in the Y warehouse, the usefulness of the information regarding the number and the quantity becomes greater due to the fact that the information regarding the location of place is added. According to the present invention, the server apparatus receives the location of place information as to where the RF tags to be counted exist. Therefore, not only the knowledge about the number of persons or articles can be acquired, but also the location of place where the counted result was acquired can be specified easily.

In the server apparatus according to the present invention, for example, the predetermined condition is to be made such that the number of counted RF tags is above a predetermined threshold value or below a predetermined threshold value. For example, in the case where the number of RF tags attached to persons is below the predetermined threshold value, this signifies that there are able to be detected the number of persons existing in a location of place where the RF tags (at a location of place with disposed RF tag readers) is small. And in the case where the number of RF tags attached to cars is above the predetermined threshold value, this signifies that the traffic at a location of place where the RF tags can be detected is heavy. As mentioned above, when the size relation between the number of counted RF tags and the predetermined threshold value is set in the server apparatus as a predetermined condition, the server apparatus can notify the user of the congestion state of the predetermined location of place via an e-mail and the like quickly. Therefore, the user can recognize the congestion state at a location of place where the user desires to know it in real time.

According to the present invention, in the server apparatus, the predetermined condition, for example, is set by using the number of the counted RF tags and the number of RF tags counted prior to the point of time pertaining to the aforementioned counted RF tags. The decrease or increase of the number of the counted RF tags with respect to the number of RF tags counted prior to the point of time pertaining to aforementioned counted RF tags can be used as the predetermined condition. Or the average value or the variance value of the number of RF tags counted within a predetermined time can be used as the predetermined condition. As mentioned above, the number of RF tags used as the predetermined condition is not limited to the number at one point of time in the future or the past, the number at the plural points of time can be used. For example, in the case where the number of RF tags detected at the present time is smaller than the number of RF tags detected at a point of time in the past, it can be presumed that the congestion state around the RF tag readers is being relieved. In the case where the number of RF tags detected at the present time is larger than the number of RF tags detected at the past time, it can be presumed that the area around the RF tag readers is being congested. As mentioned above, due to the fact that the server apparatus notifies the user of information corresponding to the increase or decrease of the number of RF tags, the user can quickly recognize the change of the congestion state in course of time. In the case where the average value or the variance value is used, the server apparatus can detect the increase or decrease in the counted results therefore, the same effect can be achieved.

According to the present invention, useful information can be provided to a user by counting the number of detected RF tags.

The present invention will become more fully understood from the detailed description given herein below and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 2 is a diagram showing an example of notifying conditions to be registered in a notifying condition storing section.

FIG. 3 is a diagram showing an example of data kept stored in a reader management server.

FIG. 4 is a diagram showing an example of data kept stored in an RF tag database in the first embodiment of the present invention.

FIG. 7 is a diagram showing an example of data kept stored in the RF tag database in the second embodiment of the present invention.

FIG. 10 is a diagram showing an example of data kept stored in a historical database of the number in the third embodiment of the present invention.

DESCRIPTION OF THE PREFERRED EMBODIMENTS

First Embodiment

Figure 1:
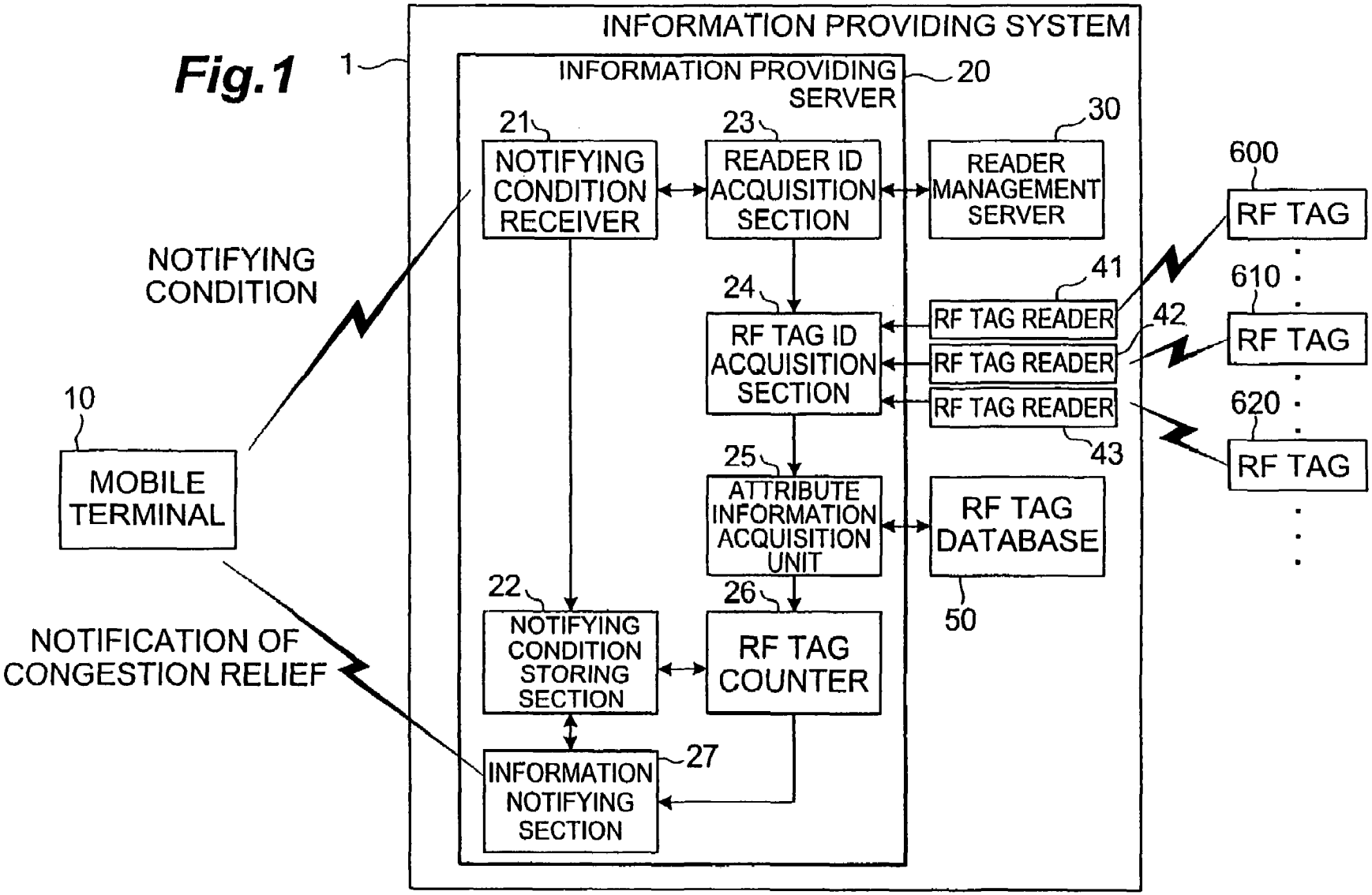
FIG. 1 is a block diagram showing a functional construction of an information providing system in the first embodiment of the present invention.

Referring now to the drawings, an information providing system at a first embodiment of the present invention is explained. FIG. 1 is a block diagram showing a functional construction of an information providing system 1 in the first embodiment of the present invention. As shown in FIG. 1, the information providing system 1 is comprised of an information providing server 20 (corresponding to server apparatus), a reader management server 30, RF tag readers 41, 42 and 43, and an RF tag database 50.

The information providing server 20 functionally comprises a notifying condition receiver 21 (corresponding to receiving unit), a notifying condition storing section 22, a reader ID acquisition section 23, an RF tag ID acquisition section 24 (corresponding to identification information acquisition unit), an attribute information acquisition unit 25 (corresponding to attribute information acquisition unit), an RF tag counter 26 (corresponding to counting unit), and an information notifying section 27 (corresponding to transmitting unit).

When the notifying condition receiver 21 has received a notifying condition transmitted from a mobile terminal 10, the notifying condition receiver 21 stores the notifying condition in the notifying condition storing section 22, and thereafter outputs the notifying condition to the reader ID acquisition section 23. Here the notifying condition is information showing a condition providing the occasion to notify a user of information being desired by the user. For example, in the case where a user desires to receive a mail, signifying to the effect that the congestion for a Ferris wheel has been relieved when the number of persons waiting in line for the Ferris wheel has become seven or less, to the mobile terminal 10, the notifying condition is "Ferris wheel in XXX amusement park, persons, seven or less". The notifying condition can include information signifying its content "congestion relief" and the destination of the information "mail address".

In the notifying condition storing section 22, the notifying condition received at the notifying condition receiver 21 is stored. FIG. 2 is a diagram showing registration contents of the notifying conditions in the notifying condition storing section 22. As shown in FIG. 2, the notifying condition storing section 22 is comprised of five data storing regions 22*a* to 22*e*. Associated with these five data storing regions are reader IDs in a location of place specified by the notifying condition, an attribute of an object to be counted, a threshold value being a criterion for judgment as to whether notifying is required or not, notifying contents, and its destination. For example, in the case where a notifying condition specified by a user is "a user desires to be notified by an e-mail through the address aaa@bbb when the number of persons waiting in line for a Ferris wheel has become seven or less", the data shown A in FIG. 2 are stored in the associated regions.

Here, the IDs of RF tag readers to be stored in the specified reader ID region 22*a* are acquired from the reader management server 30 by the reader ID acquisition section 23, in accordance with the notifying condition. For example, as shown in FIG. 3, in the reader management server 30, "in front of the Ferris wheel" is stored as a location of place, and IDs 41, 42, and 43 of three RF tag readers disposed in the location of place are stored. Therefore, in the case where the location of place information involved in the received notifying condition is "in front of the Ferris wheel", the above-mentioned three reader IDs are stored in the specified reader ID region 22*a*. Likewise, in the case where the location of place information involved in the received notifying condition is "this side of a traffic signal positioned ahead of the RF tag reader 71", the three reader IDs 81, 82, and 83 are stored in the specified reader ID region 22*a* as the reader ID associated on the reader management server 30 (refer to FIGS. 2 and 3).

Here, the correspondence between the location of place information and the reader IDs being kept stored in the reader management server 30 can be registered by a server manager beforehand. Or the correspondence can be acquired periodically by installing a position detecting apparatus such as an apparatus utilizing the GPS (Global Positioning System) in the RF tag readers.

When the reader ID acquisition section 23 has received the notifying condition from the notifying condition receiver 21, the reader ID acquisition section 23 acquires the IDs of the RF tag readers disposed in the location of place involved in the notifying condition from the reader management server 30, and outputs the acquired IDs to the RF tag ID acquisition section 24.

The RF tag ID acquisition section 24 is connected to the plural RF tag readers 41, 42, and 43 disposed in front of the Ferris wheel, and acquires the IDs of RF tags 600, 601, . . . , 610, . . . , 620, existing in communication areas of these RF tag readers via the RF tag readers 41 to 43. All of the acquired IDs of the RF tags are outputted to the attribute information acquisition unit 25.

The attribute information acquisition unit 25 inquires of the RF tag database 50 about the attribute information of the IDs of the inputted RF tags. An example of data kept stored in the RF tag database 50 is shown in FIG. 4. By the attribute information, at least a person or an article can be discriminated. In case of a person, attribute information such as name, sex, age, address, occupation, height, and character is stored. And in case of an article, attribute information such as product category, model name, country of manufacture, manufacturing company, date of manufacture, color is stored. Referring to FIG. 4, as the attribute information of a person with an attached RF tag whose ID is 600, information "person, Haruko Yamada (her name), female, student" has been stored. And as the attribute information of an article with an attached RF tag whose ID is 601, information "bag, made in Taiwan, manufactured in 2002,brown, XXX (brand name)" has been stored.

When the RF tag counter 26 has acquired the IDs of the RF tags with their attribute information from the attribute information acquisition unit 25, the RF tag counter 26 counts the number of RF tags with associated attribute information in the totally acquired RF tags. For example, in the case where all of the RF tags kept stored in the RF tag database 50 shown in FIG. 4 have been acquired, with "person" specified in terms of the notifying condition, the number of the IDs of the RF tags having attribute information "person" is for its object of counting. In FIG. 4, the IDs of the RF tags having attribute information "person" are 600, 610, 620, 630, 640, 650, and 660, and the number of these IDs is seven. Therefore, as the counted result, "seven" is outputted to the information notifying section 27.

The information notifying section 27 compares the counted result inputted from the RF tag counter 26 with the threshold value pertaining to the notifying condition kept stored in the notifying condition storing section 22 and judges whether the compared result satisfies the notifying condition or not. In the case where the compared result satisfies the notifying condition, the information notifying section 27 notifies the destination of the notifying contents involved in the notifying condition. From among the notifying conditions shown in A of FIG. 2, the notifying conditions pertaining to the threshold value in terms of the size relation are satisfied when the counted result has become seven or less, so that, in the case where the counted result is "seven", a message that the congestion has been relieved, is transmitted to the mail address of the mobile terminal 10 of the user.

Figure 5:
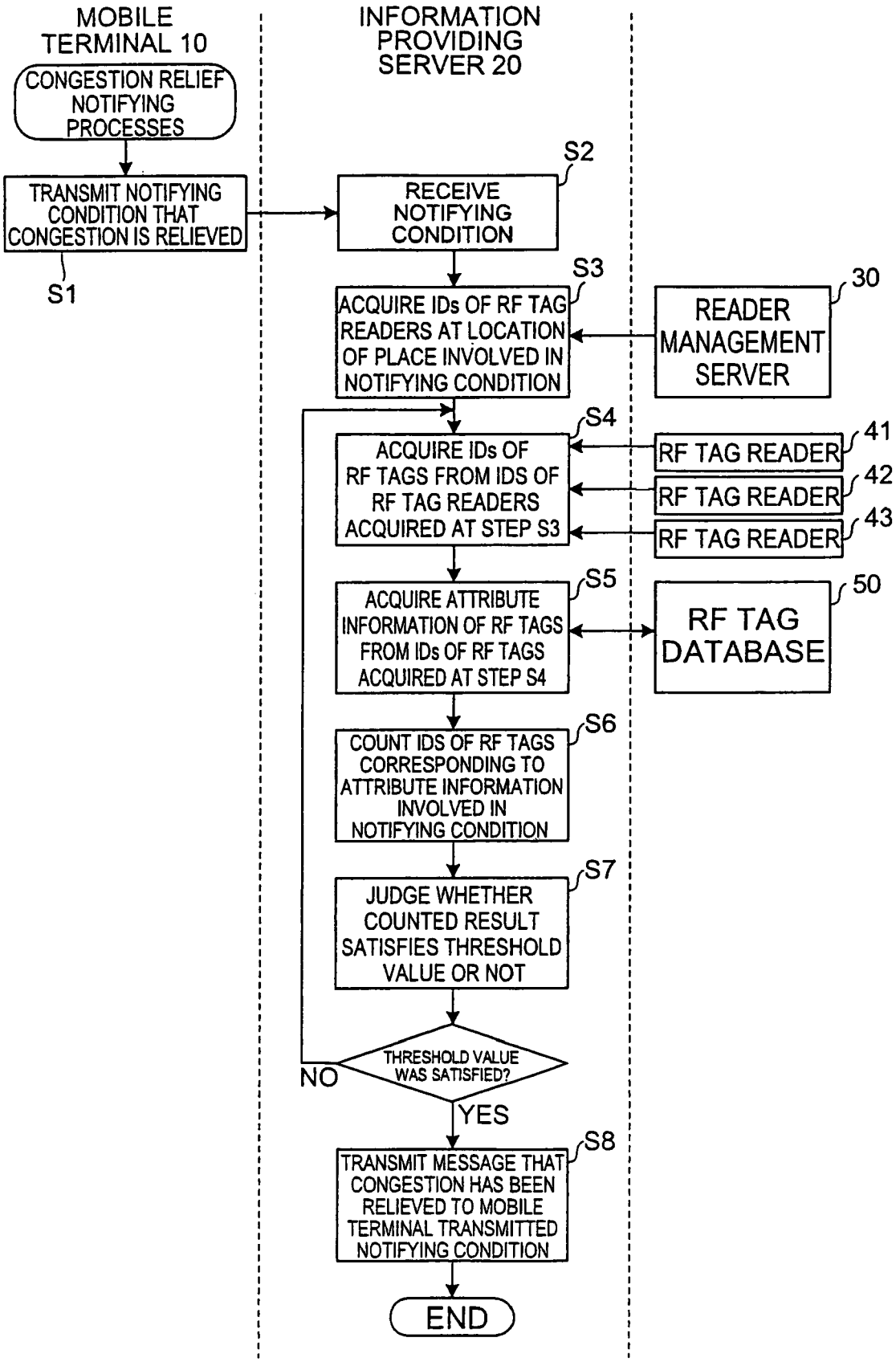
FIG. 5 is a flowchart showing congestion relief notifying processes being executed at the information providing system.

Next, referring to FIG. 5, the operation of the information providing system 1 in the first embodiment of the present invention is explained. In addition to the operation, each of steps at an information providing method of the present invention is explained. FIG. 5 is a flowchart showing congestion relief notifying processes being executed at the information providing system 1.

First, the user of the mobile terminal 10 decides a notifying condition for judging that the congestion in front of the Ferris wheel has begun relieved, and transmits the notifying condition to the information-providing server 20 by using an e-mail (step S1). In the first embodiment of the present invention, the notifying condition is assumed to be such that "an e-mail is transmitted to an address aaa@bbb when the number of persons waiting in line for the Ferris wheel has become seven or less."

The information-providing server 20 receives the mentioned-above notifying condition by means of the notifying condition receiver 21 (step S2). The information providing server 20 acquires the IDs 41, 42, and 43 (refer to FIG. 3) of the RF tag readers disposed in front of the Ferris wheel from the reader management server 30 by means of the reader ID acquisition section 23 (step S3).

The information-providing server 20 acquires, by means of the RF tag ID acquisition section 24, IDs 600 to 660 of RF tags detected by the RF tag readers 41, 42, and 43 having each ID acquired at the step S3 (step S4). Further, the information-providing server 20, acquires, by means of the attribute information acquisition unit 25, attribute information of persons or articles with attached RF tags having each ID acquired at the step S4 (step S5).

Next, the RF tag counter 26 counts the number of IDs of the RF tags having attribute of a person from the attribute information acquired at the step S5 (step S6). When FIG. 4 is referred to again, the number of IDs, in which a person is included in the attribute information, is seven being 600, 610, 620, 630, 640, 650, and 660. Therefore, the number of persons waiting in line for the Ferris wheel can be estimated as seven.

The information notifying section 27 judges whether the counted result "seven persons" satisfies the threshold value involved in the above-mentioned notifying condition or not (step S7). In the first embodiment of the present invention, the threshold value being part of the notifying condition has been set as "seven persons or less", so that "seven persons" satisfies the notifying condition (YES at the step S7). Therefore, the information notifying section 27 judges that the congestion state in front of the Ferris wheel has been relieved to the extent of being desired by the user, and transmits a message that the congestion has been relieved, to the e-mail address aaa@bbb of the mobile terminal 10 (step S8). The user of the mobile terminal 10 recognizes that the congestion has been relieved at the location of place where the user desires to know the relief state of the congestion(in front of the Ferris wheel) easily and quickly, by reading the received e-mail.

Here, in the case where the counted result at the step S6 has not satisfied the threshold value being a part of the notifying condition, that is, eight or more persons are waiting in line for the Ferris wheel (NO at the step S7), the process returns to the step S4, and processes after the step S4 are executed continuously.

As explained above, in the first embodiment of the present invention, the information providing system 1 counts the number of persons waiting in line for the Ferris wheel in response to the request of the user. And at the time when the number of persons has become seven or less, the information providing system 1 notifies the user of the situation wherein the congestion has been relieved. Therefore, the user in the amusement park can recognize the situation wherein the congestion in front of the Ferris wheel has been relieved easily and quickly. As a result, the user can get on the Ferris wheel without waiting in line for a long time and can use time effectively.

Second Embodiment

Figure 6:
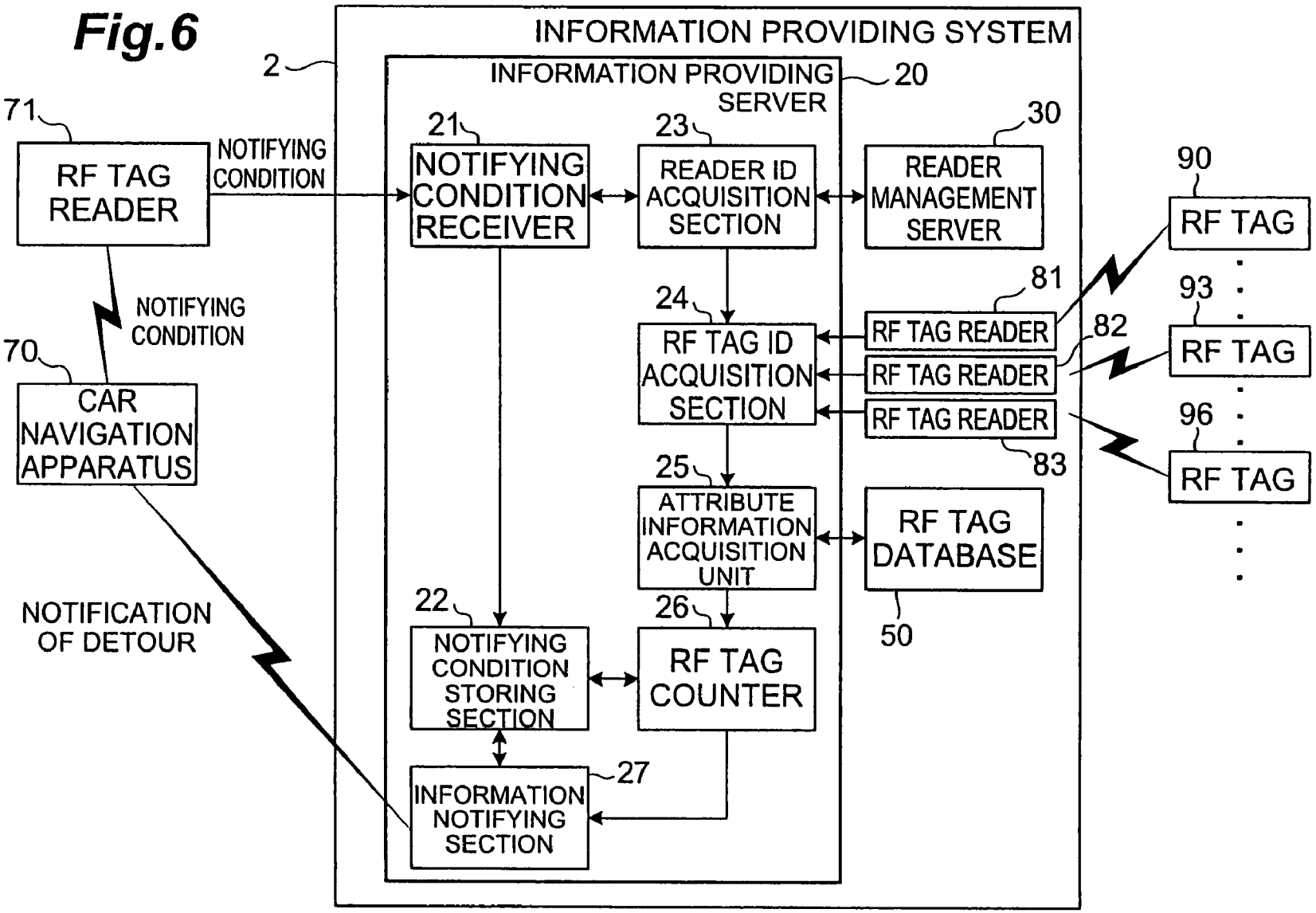
FIG. 6 is a block diagram showing a functional construction of an information providing system at a second embodiment of the present invention.
Figure 8:
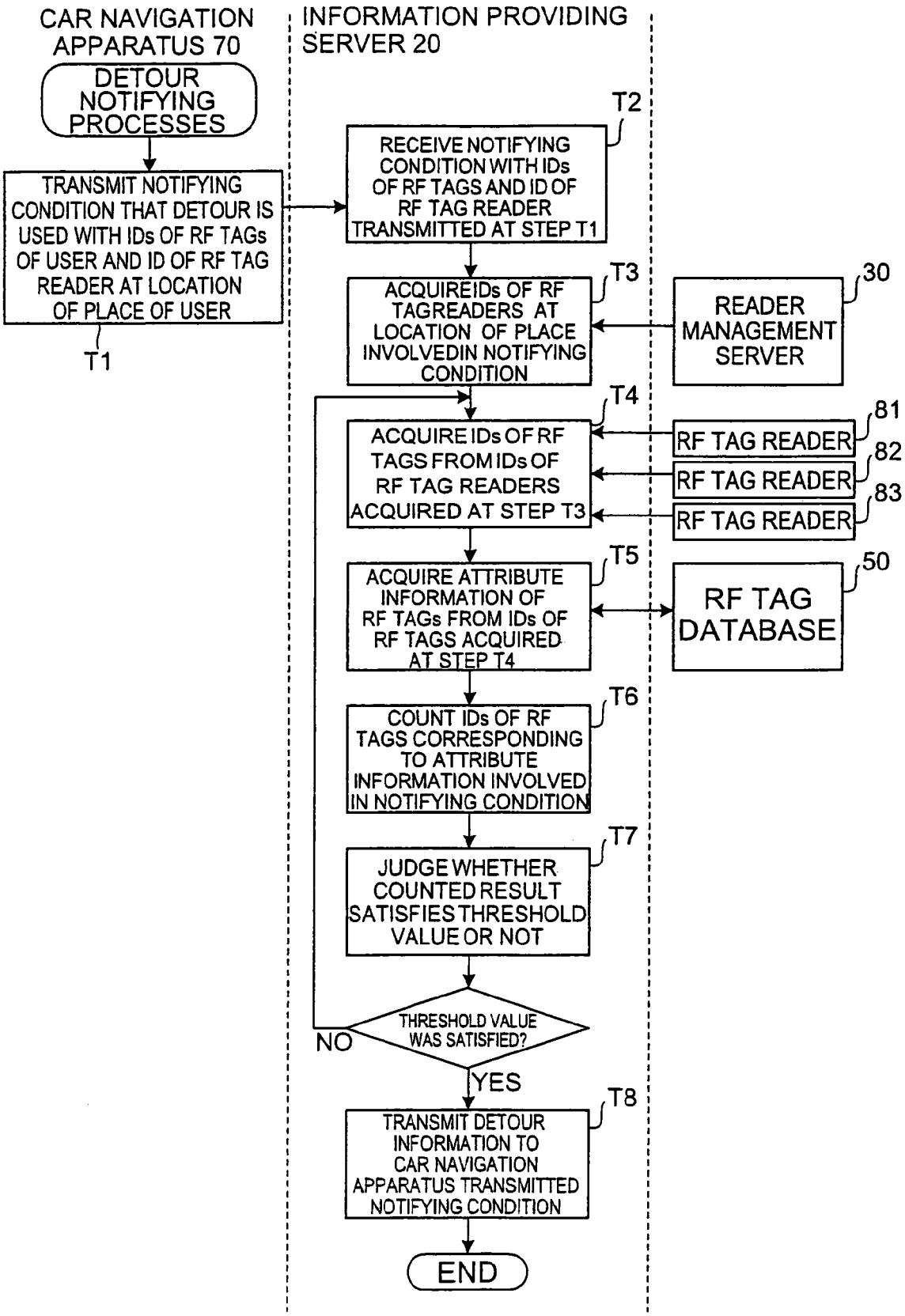
FIG. 8 is a flowchart for explaining detour notifying processes.

Next, referring to FIGS. 6 to 8, an information providing system at a second embodiment of the present invention is explained. In the information providing system in the first embodiment of the present invention, the transmission of the notifying condition and the notification of the relief from the congestion are executed by using a mobile terminal. However, in the second embodiment, it is assumed that the notifying condition is transmitted via an RF tag reader and information is transmitted to a car navigation apparatus connected to a network. At the same time, in the second embodiment, it is assumed that a driver of a car desires that the car should be navigated to use a detour corresponding to the congestion state of an intersection in the moving direction.

FIG. 6 is a block diagram showing a functional construction of an information providing system 2 in the second embodiment of the present invention. As shown in FIG. 6, the main parts of the construction of the information providing system 2 are the same as the information providing system 1 explained in detail in the first embodiment. Therefore, each of the same constructional sections has the same reference number, and the same explanation is omitted. Therefore, the difference from the first embodiment will be explained.

FIG. 7 is a diagram showing an example of data kept stored in the RF tag database 50 in the second embodiment of the present invention. As shown in FIG. 7, in the RF tag database 50, the IDs of the RF tags and their attribute information have been stored by associating them with each other. That is, as the IDs of the RF tags, 90, 91, 92, . . . 98 have been stored, for example, as the attribute information corresponding to the ID "90" of the RF tag, there is kept stored information representing features of the car such as "car, sedan, manufactured in 1998,four doors, green, with car navigation apparatus".

Next, referring to FIG. 8, as the operation in the second embodiment, detour notifying processes are explained. In addition to the operation, each of steps at an information providing method of the present invention is explained. Here, the detour notifying processes are basically equal to the congestion relief notifying processes explained in detail in the first embodiment (refer to FIG. 5). Actually, steps T1 to T8 in FIG. 8 correspond to the steps S1 to S8 in FIG. 5 respectively.

First, a car navigation apparatus 70 transmits notifying condition "in the case where five or more other cars exist at an intersection where a car of one's own is to pass, another route being not congested is navigated as a detour", as the notifying condition (step T1). This notifying condition is transmitted to the information-providing server 20 via an RF tag reader 71. Further, the notifying condition is transmitted to the information providing server 20 with "97" being the ID of the RF tag of the car of the user (a car of one's own), "98" being the ID of the RF tag of the user, and "71" being the ID of the RF tag reader 71

The information providing server 20 receives the notifying condition, the IDs "97" and "98" of the RF tags, the ID "71" of the RF tag reader 71 transmitted at the step T1 by means of the notifying condition receiver 21 (step T2). The reader ID acquisition section 23 specifies RF tag readers 81, 82 and 83 disposed at the location of place before a traffic signal positioned one ahead of the RF tag reader 71 from the RF tag reader 71 having the ID received at the step T2 (step T3). The specifying of the RF tag readers 81 to 83 is enabled by referring to the data-storing region 32 (refer to FIG. 3) in the reader management server 30.

The RF tag ID acquisition section 24 acquires IDs of RF tags detected by the RF tag readers 81, 82, and 83 in their communication areas (step T4) When the attribute information acquisition unit 25 acquires the IDs of these RF tags, the attribute information acquisition unit 25 acquires attribute information of persons or articles with attached RF tags, referring to the RF tag database 50 shown in FIG. 7 (step T5). Thereafter, the RF tag counter 26 counts the number of IDs of the RF tags having attribute of a car from among the attribute information acquired at the step T5 (step T6). When FIG. 7 is referred to, the number of IDs, in which a car is included in the attribute information, is seven being 90 to 96.

The information notifying section 27 judges whether the counted result "seven cars" satisfies the threshold value involved in the notifying condition received at the step T2 or not (step T7). In the second embodiment of the present invention, the threshold value being part of the notifying condition has been set as "five cars or more", so that "seven cars" satisfies the notifying condition (YES at the step T7). Here, the number of cars "five" being set in threshold value is the number of cars, which is expected to be able to pass the traffic signal during the time interval between the point of time with the traffic signal having turned from red to green and the point of time with the traffic signal having turned to red again.

The information notifying section 27 judges that the number of other cars stopping right before the traffic signal is large and the user should use a detour, and transmits detour information to the IP (Internet protocol) address of the car navigation apparatus 70 (step T8). The IP address is "192.168.0.2", which can be specified by referring to the attribute information of the ID "97" of the RF tag in the attribute information acquired at the step T5 (refer to FIG. 7). The car navigation apparatus 70 navigates the user corresponding to the received detour information. Thereby, the user can drive on a route that is not so congested.

Here, in the case where the counted result at the step T6 has not satisfied the threshold value being part of the notifying condition, that is, the number of other cars stopping right before the traffic signal is less than five, (NO at the step T7), the process returns to the step T4, and processes after the step T4 are executed continuously.

As explained above, in the second embodiment of the present invention, the information providing system 2 counts the number of other cars stopping at a traffic signal of an intersection positioned ahead of the user in response to the request of the user. And in the case where the number of other cars is five or more, the information providing system 2 notifies the user of the fact that the user could arrives at the goal quicker by using a detour via the car navigation apparatus. Therefore, the user of a car approaching the intersection can know a route by which the user can earlier arrive at the goal easily and quickly.

Third Embodiment

Figure 11:
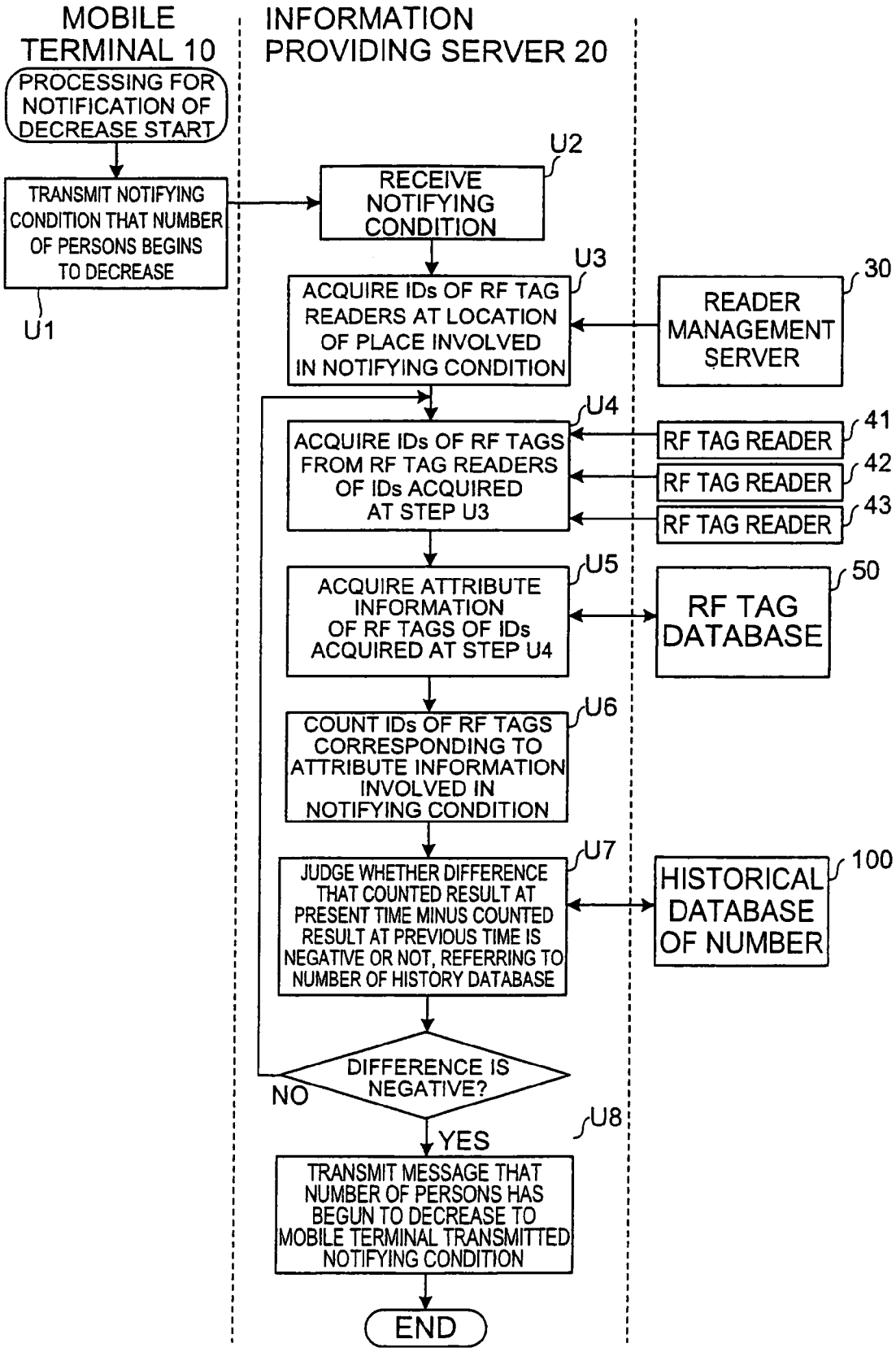
FIG. 11 is a flowchart for explaining processing for notification of decrease start being executed at the information providing system in the third embodiment of the present invention.

Next, referring to FIGS. 9 to 11, an information providing system according to third embodiment of the present invention will be explained. In the information providing system in the first embodiment of the present invention, in the case where the number of persons in front of the Ferris wheel has become the number being a predetermined threshold value (seven or less), the user is notified of the relief from the congestion. However, in the third embodiment, the information providing system monitors the number of persons in front of the Ferris wheel at every predetermined interval, and at the point of the time when the number of persons has begun to decrease, the information, that the congestion has begun to be relieved, is notified to the user.

Figure 9:
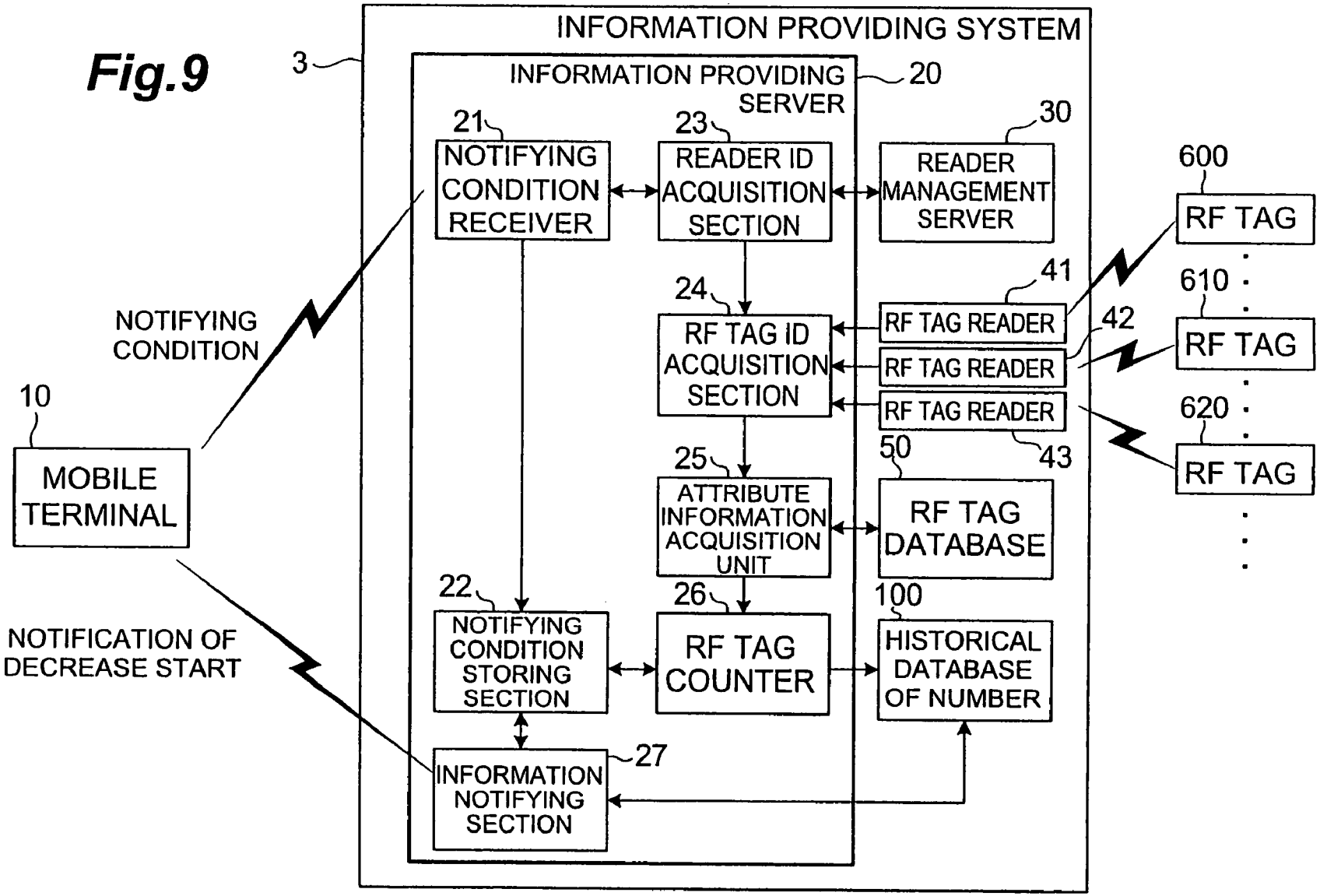
FIG. 9 is a block diagram showing a functional construction of an information providing system in the third embodiment of the present invention.

FIG. 9 is a block diagram showing a functional construction of an information providing system 3 in the third embodiment of the present invention. As shown in FIG. 9, the main parts of the construction of the information providing system 3 are the same as the information providing system 1 explained in detail in the first embodiment. Therefore, each of the same constructional sections has the same reference number, and the same explanation is omitted. Therefore, the difference from the first embodiment is explained.

FIG. 10 is a diagram showing an example of data kept stored in a historical database of the number 100 being characteristically peculiar in the third embodiment of the present invention. As shown in FIG. 10, in the historical database of the number 100, there are kept stored predetermined point of time and the number of RF tags detected by the RF tag readers 41 to 43 at the predetermined time for every attribute in association with each other. For example, as shown in FIG. 10, as the attributes and the number of the RF tags detected at the time "13:00", information showing "persons are four, bags are two, and mobile phone is one" has been stored.

Likewise, as information associated with the time "13:05", there are kept stored information showing "persons are five, bags are two, hat is one, and mobile phone is one". As information corresponding to the time "13:10", there are kept stored information showing "persons are eight, bags are five, hats are two, and mobile phone is one" has been stored. Further, information of the RF tags detected at the time "13:15", information showing "persons are seven, bags are five, hat is one, and mobile phone is one" has been stored. The information-providing server 20 grasps the increase or decrease in the number of persons in front of the Ferris wheel for every five minutes, by referring to the historical database of the number 100.

Next, referring to FIG. 11, as the operation in the third embodiment, processing for notification of decrease start will be explained. In addition to the operation, each of steps constituting an information providing method of the present invention is explained. Now, the processes for notification of decrease start include almost equal processes similar to the congestion relief notifying processes explained in detail in the first embodiment (refer to FIG. 5). Actually, steps U1 to U8 in FIG. 11 correspond to the steps S1 to S8 in FIG. 5 respectively.

First, the user of the mobile terminal 10 decides a notifying condition for judging that the congestion in front of the Ferris wheel has begun to be relived, and transmits the notifying condition to the information providing server 20 by using an e-mail (step U1). In the third embodiment of the present invention, the notifying condition is assumed to be such that "an e-mail is transmitted to an address aaa@bbb when the number of persons waiting in line for the Ferris wheel has begun to decrease."

The information-providing server 20 receives the mentioned-above notifying condition by means of the notifying condition receiver 21 (step U2). The information providing server 20 acquires the IDs 41, 42, and 43 (refer to FIG. 3) of the RF tag readers disposed in front of the Ferris wheel from the reader management server 30 by means of the reader ID acquisition section 23 (step U3).

The information providing server apparatus 20, acquires, by using the RF tag ID acquisition section 24, IDs 600 to 660 of RF tags detected by the RF tag readers 41, 42, and 43 having each ID acquired at the step U3 (step U4). Further, the information providing server apparatus 20 acquires, by using the attribute information acquisition unit 25, attribute information of persons or articles with attached RF tags having each ID acquired at the step U4 (step U5).

Next, the RF tag counter 26 counts the number of IDs of the RF tags every attribute, referring to the attribute information acquired at the step U5 (step U6). In this, the present time is "13:15". When FIG. 4 is referred to again, the number of IDs, in which a person is included in the attribute information, is seven being 600, 610, 620, 630, 640, 650, and 660. And the number of IDs, in which a bag is included in the attribute information, is five being 601, 611, 621, 641, and 651. And the number of IDs, in which a hat is included in the attribute information, is one being 631. And the number of IDs, in which a mobile phone is included in the attribute information, is one being 652. Therefore, the number of persons waiting in line for the Ferris wheel can be estimated as seven at the present time "13:15".

The information notifying section 27 judges whether the difference being the number of persons in front of the Ferris wheel at the present time minus at the previous time is negative (step U7). That is, it is judged whether the number of persons at the present time has decreased or not, compared with the number of persons at the previous time. This judgment is executed by referring to the historical database of the number 100. That is, when FIG. 10 is referred to, the counted result at the step U6 corresponds to the time "13:15" and the difference being the number of persons at the present time "13:15" minus at the previous time "13:10" is −1 (=7-8). That is, this figure is negative, therefore, it can be recognized that the number of persons in front of the Ferris wheel changed to a decreasing state (YES at the step U7). Therefore, the information notifying section 27 transmits a message that the number of persons in front of the Ferris wheel has begun to decrease to the e-mail address aaa@bbb of the mobile terminal 10 (step U8). As a result, the user of the mobile terminal 10 can recognize that the congestion has begun to be relieved at the location of place where the user desired to know (in front of the Ferris wheel) easily and quickly, by reading the received e-mail.

In this, in the case where the difference being the counted result of the person attribute at the step U6 minus that at the previous time is 0 positive (NO at the step U7), it can be estimated that the number of persons in front of the Ferris wheel is not changing or increasing. Therefore, the process returns to the step U4, and processes after the step U4 are executed again.

As explained above, in the third embodiment of the present invention, the information providing system 3 counts the number of persons waiting in line for the Ferris wheel every specified interval, corresponding to the request of the user. And the counted result is historically stored in the historical database of the number 100. And in the case where the counted number changed to a decreasing state, the decreasing state is notified to the user. Therefore, the user in the amusement park can recognize that the congestion state in front of the Ferris wheel has begun to be relieved easily and quickly. As a result, the user can get on the Ferris wheel without waiting in line for a long time and can use time effectively.

In the third embodiment of the present invention, as the criterion for judgment, it is used that the number of persons has decreased, that is, it is used that the number of the IDs of the RF tags, whose attribute is a person, has decreased by one or more from the previous time. However, the criterion for judgment is not limited to this, in addition to the person, an article such as a bag and a hat shown in FIG. 10 can be added as a counting object. Or, as the threshold value, there can be used occurrence of the following cases: a case where that some number of persons or more have decreased, a case where some number of times the number of the persons consecutively has decreased, and a case where the number of persons has decreased within a predetermined period of time, these cases can be applied to the threshold value. Further, the decrease of the number of persons can be recognized due to the fact that the average value or the variance value of the number of the RF tags detected at a predetermined interval (for example, five minutes) has decreased.

Incidentally, the present invention is not to be restricted by the above-mentioned embodiments. It is to be appreciated that those skilled in the art can change or modify the embodiments without departing from the scope and sprit of the present invention.

For example, in the first to third embodiments, the reader management server apparatus 30, the RF tag database 50, and the historical database of the number 100 are constructed separated from the information providing server apparatus 20. However, these apparatuses can be integrated. Further, the main three functions (notifying condition registering function, notifying condition matching judgment function, and information notifying function), which the information providing server apparatus 20 provides, can be distributed to separate server apparatus. Thereby, the transparency in terms of positioning in the system is to be enhanced.

Moreover, in the first to third embodiments, as the notifying condition, the congestion state of persons or cars is set, however, the notifying condition is not limited to the congestion state. For example, at Akihabara (a location of place in Tokyo), it is judged that an event is held at a location of place where persons being more than a specified number gather. And there is also to be provided a notification of the contents and the starting time of the event. Further, there could be also accomplished a mode of operation, wherein in the case where the stock number of merchandise held in the warehouse as the stock has become less than the predetermined number, instructions for an additional ordering for the merchandise instructions could be given to replenish the merchandise as the stock replenishment.

Furthermore, a part or all parts of the notifying condition are not limited to items, which are instructed explicitly by a user of the mobile terminal 10 or the car navigation apparatus 70. The items, which are set beforehand in the information providing server apparatus 20 by a system management person, can be used. In this case, at the time when the notifying condition is set, it is possible that the tastes or likings and the behavior characteristics of users are taken into account, however, it is also possible that these are not taken into account.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A server apparatus, comprising:

a notifying condition storing unit configured to store a predetermined condition, said predetermined condition identifying specified attribute information and a notifying condition;

an identification information acquisition unit configured to acquire identification information of RF tags detected by RF tag readers;

an RF tag storing unit configured to store attribute information of the RF tags by storing descriptive information corresponding to each of the separate identification information of the RF tags, wherein the descriptive information for each of the identification information includes a plurality of descriptors describing an object or person associated with a respective RF tag;

an attribute information acquisition unit configured to acquire, from the RF tag storing unit, the attribute information of the RF tags having said identification information acquired by said identification information acquisition unit;

a counting unit configured to count a number of RF tags corresponding to the specified attribute information identified in the predetermined condition from among said detected RF tags;

a transmitting unit configured to transmit information corresponding to the predetermined condition to an external device, in the case where the number of said RF tags counted by said counting unit satisfies the predetermined condition;

a receiving unit configured to receive, from the external device, the predetermined condition and destination information for the transmitting unit to use to transmit the information corresponding to the predetermined condition.

2. The server apparatus according to claim 1, wherein the receiving unit is configured to receive information regarding a location of place from the external device, and said identification information acquisition unit is configured to acquire identification information of RF tags detected by RF tag readers disposed near by said location of place.

3. The server apparatus according to claim 1, wherein:

said predetermined condition is set by employing the number of said counted RF tags and a number of RF tags counted prior to the point of time pertaining to said counted RF tags.

4. An information providing method, comprising:

storing a predetermined condition, said predetermined condition identifying specified attribute information and a notifying condition;

acquiring identification information of RF tags detected by RF tag readers;

acquiring stored attribute information of the RF tags having said identification information acquired by said acquiring identification information, wherein the stored attribute information includes descriptive information corresponding to each of the separate identification information of the RF tags, the descriptive information for each of the identification information includes a plurality of descriptors describing an object associated with a respective RF tag;

counting the number of RF tags corresponding to the specified attribute information identified in the predetermined condition from among said detected RF tags;

transmitting information corresponding to the predetermined condition to an external device, in the case where the number of said RF tags counted by said counting satisfies said predetermined condition;

receiving, from the external device, the predetermined condition and destination information used for the transmitting the information corresponding to the predetermined condition.

5. The server apparatus according to claim 1, wherein at least one of the plurality of descriptors is the same for at least two of the identification information stored in the RF tag storing unit.

6. The server apparatus according to claim 1, wherein the notifying condition corresponds to a threshold value.

7. The server apparatus according to claim 1, wherein the external device is a car navigation apparatus of a first vehicle, and the notifying condition corresponds to a threshold number of other vehicles having RF tags which are located at a traffic intersection along a route that the first vehicle may take.

8. The server apparatus according to claim 1, wherein the notifying condition corresponds to a point in time when a number of RF tags near a specified RF tag reader has begun to decrease.

* * * * *